US005795106A

United States Patent [19]

Herd

[11] Patent Number: 5,795,106

[45] Date of Patent: Aug. 18, 1998

[54] RETAINING WALL SYSTEM AND METHOD OF CONSTRUCTION THEREOF

[76] Inventor: Ian M. Herd, P.O. Box 1451, Pine Bluff, N.C. 28373

[21] Appl. No.: 617,727

[22] Filed: Apr. 1, 1996

[51] Int. Cl.[6] ..... E02D 17/09

[52] U.S. Cl. ..... 405/284; 52/DIG. 9; 405/286

[58] Field of Search ..... 47/DIG. 13; 52/DIG. 9; 405/128, 129, 258, 284, 286

[56] References Cited

U.S. PATENT DOCUMENTS 4,057,141 11/1977 Laurie et al. ..... 52/DIG. 9 X 4,080,793 3/1978 Pulsifer ..... 52/DIG. 9 X 5,507,127 4/1996 Gates ..... 52/DIG. 9 X

*Primary Examiner*—Tamara L. Graysay

*Assistant Examiner*—Tara L. Mayo

*Attorney, Agent, or Firm*—Bereskin & Parr

[57] ABSTRACT

A retaining wall system comprising a plurality of scrap tire bales arranged to define a retaining wall structure. A structural material is positioned or applied about the scrap tire bales in order to provide a continuous retaining wall structure serving to retain water, control erosion, support buildings and associated structures, provide a barrier or fence, or other similar functions.

20 Claims, 5 Drawing Sheets

RETAINING WALL SYSTEM AND METHOD OF CONSTRUCTION THEREOF

BACKGROUND OF THE INVENTION

This invention relates to a novel retaining wall system and method of construction thereof. More specifically, this invention is directed to a novel system comprising a plurality of scrap tire bales arranged in conjunction with other engineering materials to form a retaining wall structure. The retaining wall structure of the present invention may be advantageously used in the construction of dams or levees for the retention of water, structures for erosion control, foundations in the construction of buildings and associated structures (e.g. boat docks, river bank stabilization structures, hill side building foundations, costume rock formations, etc.), in the construction of barriers or fences, and other similar applications. The system of the present invention concomitantly provides a valuable and environmentally safe technique for scrap tire disposal.

Scrap Tire Disposal

Every year in the United States there are 250 million scrap tires generated. Moreover, there are currently over four billion scrap tires located in illegal dump sites across the United States. The existence of these scrap tires create environmental hazards and concerns. The potential for severe fire and/or smoldering of scrap tire stock piles exists across the United States. State and local landfills have become burdened by the large landfill resources required to dispose of used tires. In fact, most local and state authorities charge tire merchants a disposal fee of one to two dollars per standard automobile tire. Of course, this cost is normally passed on to the consuming public.

Due to the cost and burdens associated with safely disposing of used tires, many states pay private contractors up to one dollar per tire to safely dispose of tires. The potential economic benefit gained from properly disposing of used tires has lead many to attempt to solve the disposal problems noted above.

A common technique for disposing of whole tires is to shred the tires into discrete pieces and dumping the scraps into landfills. Although this decreases the overall landfill volume required for disposal and prevents tires from floating, it does not address other problems associated with tire disposal. First, the tires still present fire and/or contamination problems discussed above. Second, the process of shredding adds significant cost to the disposal process without any associated cost benefit. Moreover, tire shredding does not offer an alternative productive use for scrap tires and continues to present many landfill problems.

Recycling scrap tires into other commercially useful products offers another disposal alternative. Tires are often used to make other petroleum based products such as floor mats. However, because of the problems attributed to recycling, such as cost and lack of potential use, less than 7% of scrap tires are recycled in this manner. Accordingly, tire recycling has not proven to be a viable tire disposal alternative.

Attempts have been made to utilize scrap tires as an energy source. Specifically, furnaces have been developed to burn scrap tires in the creation of heat energy. This disposal technique has also proven of limited value. First, high capital cost associated with the development and construction of furnaces has curtailed their widespread use. Moreover, other environmental concerns are associated with the burning of tires.

Retaining Wall Systems

Many systems have been utilized in the past in the construction of dams or levees, erosion control barriers, and foundations for building structures. One of the most important components in any construction is the aggregate material that either serves as an earth fill material or as a part of the support structure. The costs of aggregate material dramatically varies depending on the location of a construction site. For example, a local supply of aggregate material such as gravel can cost in a range from $3.00 to $8.00 per cubic yard. Of course, this cost can dramatically increase when additional transportation costs are necessary; for example, an additional transportation charge of $1.00 per mile is a typical charge in the industry. A need exists in the industry for a cost effective supply of aggregate material that is readily available in proximity to any construction site.

Although significant attention has been devoted to scrap tire disposal and the construction of retaining wall systems in the past, all have limitations and none have proven successful in providing a cost effective method for disposing of scrap tires, on a large scale basis, while providing a useful function for the scrap tires.

OBJECTS AND BRIEF SUMMARY OF THE INVENTION

It is therefore a general object of the invention to provide a novel retaining wall system which will obviate or minimize difficulties of the type previously described.

It is a specific object of the invention to provide a novel retaining wall system that provides a means for an environmentally safe and large scale utilization of scrap tires.

It is still another specific object of the invention to provide a novel retaining wall system that can be utilized in a variety of different applications including the construction of dams or levees for the retention of water, structures for erosion control, foundations in the construction of buildings and associated structures (e.g. boat docks, river bank stabilization structures, hill side building foundations, costume rock formations, etc.), and in the construction of fences or the like.

It is yet another specific object of the invention to provide a novel retaining wall system that utilizes tire bales in order to provide a cost effective source of aggregate fill material.

It is still another specific object of the invention to provide a novel retaining wall system that utilizes scrap tire bales in conjunction with a structural material in order to provide a continuous and firm retaining wall structure.

It is another specific object of the invention to provide a novel retaining wall system that incorporates scrap tire bales for permanent use or short term objectives such as temporary flood control walls, temporary berms for mud slides, hill stabilization, temporary mounds used for berms inside stadiums for racing events, etc.

It is another specific object of the invention to provide a novel method of constructing a retaining wall system that incorporates scrap tire bales and reduces project installation time.

BRIEF SUMMARY OF A PREFERRED EMBODIMENT OF THE INVENTION

A preferred embodiment of the invention which is intended to accomplish the foregoing includes a system comprising a plurality of scrap tire bales arranged to define a retaining wall structure. A structural material is positioned or applied about the scrap tire bales in order to provide a continuous retaining wall structure serving to retain water, control erosion, support buildings and associated structures, provide a barrier or fence, or other similar applications for long or short term use.

DRAWINGS

Other objects and advantages of the present invention will become apparent from the following detailed description of a preferred embodiment thereof taken in conjunction with the accompanying drawings, wherein:

FIGS. 8A–8C are schematic diagrams of the progressive construction steps for one embodiment of the present invention configured as an animal containment facility for use in a zoo or the like.

DETAILED DESCRIPTION

Figure 1:
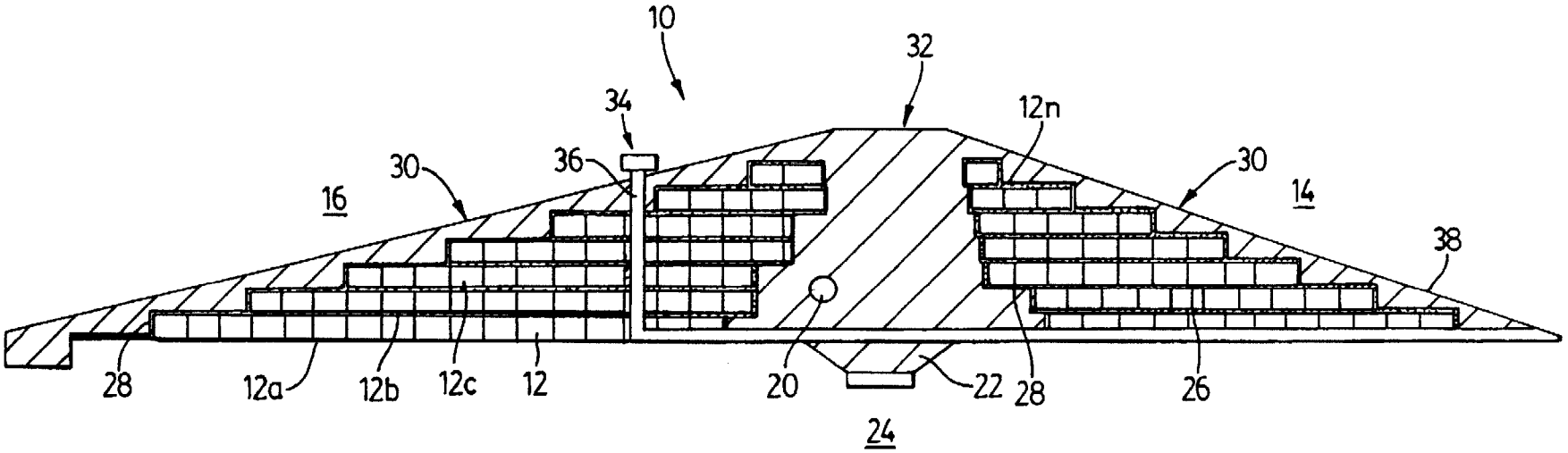
FIG. 1 is a schematic cross-section of a retaining wall system configured as dam in accordance with the novel system of the present invention.

Referring now to FIG. 1, there is shown a dam or levee 10 having a water side 14 and a leeward side 16 constructed in accordance with the system of the present invention. In the construction of dams or levees, the lack of aggregate fill material poses a problem in many construction applications. The dam or levee 10 of the present invention incorporates waste scrap tires in order to improve the structural integrity of the dam or levee and provide an environmentally sound disposal mechanism that will not adversely affect the environment. The dam 10 of the present invention incorporates a plurality of tire bales 12.

In the preferred embodiment, each of the tire bales 12 is formed from 90–105 whole tires. In a conventional bale machine, 100 tires, for example, are inserted and compressed into an approximately 2.5×4×5 foot bale or about 2.3 cubic yards each in order to form a distinct tire bale. At least one binding strap, preferably metallic, is wrapped around the bale to form a distinct block for use in the system of the invention. The size of the bales and the number of tires per bale are dependent on the site of the system and the particular application. The novel use of tire bales 12 in the retaining wall system 10 of the present invention dramatically reduces the cost of aggregate fill. For example, in a dam 10 constructed as shown in FIG. 1 with a 3/1 water side grade and 4/1 leeward side grade, approximately 55,000 cubic yards of fill is replaced with tire bales 12 (approximately 24,000 tire bales or 2.4 million tires). Although the cost of aggregate fill varies depending on transportation costs, local aggregate fill often costs in the order of $4.00 per cubic yard. As such, the use of tire bales provides a savings in the order of $220,000.00 in a single dam project.

Figure 2A:
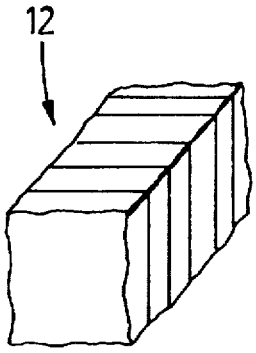
FIG. 2A is a perspective view of a baled tire utilizing shredded scrap tire molded in a cement mixture in accordance with the novel system of the present invention.
Figure 2B:
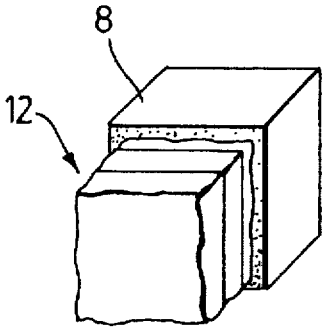
FIGS. 2B & 2C are sectional perspective and perspective views, respectively, of a baled tire formed with shredded scrap tire molded in a cement mixture, as depicted in FIG. 2A, that is further encapsulated in an outer concrete shell in accordance with the novel system of the present invention.
Figure 2C:
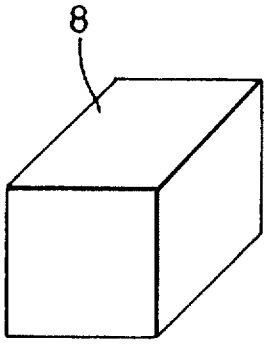

In an alternative embodiment, the system of the present invention could use shredded tire, as opposed to whole tires, or a combination of shredded tire and whole tire. Using shredded tire requires placing whole tires in a shredding machine to form smaller pieces of tire as known in the art. As shown in FIG. 2A, the shredded tire is molded as a distinct concrete bale 12. To construct the shredded tire bale 12, a mixture of 2 parts cement, 3 parts sand, and 4 parts shredded scrap tire is placed in an appropriately sized mold (e.g. 3×3×6 feet is suitable for most engineering applications) and permitted to set. As shown in FIGS. 2B and 2C, the tire bale 12 may be completely encapsulated with a concrete shell 8 in order to form a geometrically precise and an aesthetically pleasing bale. The bales 12 (encapsulated or not encapsulated) are easily maneuvered and stacked upon one another thereby permitting easy construction in any engineering application.

The dam or levee 10 further comprises a clay core 20 including a clay core cut-off trench 22 which is constructed in the center of the dam or levee 10 in the manner known in the art. A plurality of tire bales 12 are positioned on both the water side 14 and leeward side 16 in a series of layers **12*a*–12*n*. As shown in the exemplary embodiment, a bottom tire bale layer 12*a* is positioned on a foundation soil or bedrock 24 on both sides of the clay core 20. Additional tire bale layers 12*b*, 12*c*, . . . 12*n* are positioned until the required height of the dam or levee is obtained. Each subsequent layer 12*n* is off-set from the previous layer to permit the proper slope along the outside surface 30 of the dam. The first or bottom layer 12*a* extends the greatest linear distance from the clay core 14, with each subsequent layer 12*b*–12*n* extending, in turn, a smaller linear distance. The shifting of the tire layers also serves to provide support for the rubber against the clay core 20 at the center of the structure. The tire bales 12 are also stacked in the width of the dam 10 (into the paper of FIG. 1) in horizontal layers approximately 30 inches thick throughout the width of the structure on each side of the clay core 20**.

Preferably, a layer of sandy clay 26 is interposed between each tire bale layer **12*a*–12*n*, preferably in the order of 6 to 12 inches. The layer 26 serves to seal the horizontal and vertical joints of the tire bales 12, and also serves as a mortar to fill any pockets between adjacent tire bales 12. A water pervious membrane 28 separates the outer clay cap 30 and the tire bale layers 12*a*–12*n* as shown. The water pervious membrane 28 also separates the clay core 20 and the tire bale layers 12*a*–12*n* as shown. The water pervious membrane 28 will cover the exposed bales 12 to permit any water to filter through the tire bale layer 12*n*–12*a* on the one hand, but prevent the clay cap 30, core 20, and other surface soils from eroding into the tire fill layers. The membrane 28** may be constructed from any material suitable for this purpose. For example, it may be fabricated from nylon, fiberglass, burlap or the like known in the art.

A structural material is applied about the exposed surfaces of the tire bales 12. In the embodiment shown, the structural material comprises a clay cap 30 that provides a final seal for the dam or levee and creates a continuous retaining wall structure. The clay material is positioned over each of the exposed surfaces of the tire bales in the layers as shown in FIG. 1. The clay cap 30 is graded from the bottom of the dam structure to the crest 32 of the dam 10. In the embodiment shown, the clay cap 30 that defines the water side 14 has a pitch of 3 to 1 and the clay cap 30 that defines the leeward side 16 has a pitch of 4 to 1. In general, however, the pitch of the wall surfaces depends on the nature of the specific dam or levee application. The clay cap 30 is preferably in the order of 12 inches in depth in order to provide reliable water retainment. A layer of top soil is provided over the clay cap 30 as required to support vegetation. In an alternative embodiment, the structural material could be concrete.

Primary and secondary spillway structures are installed as conventional in the art. For example, a spillway 34, including drain piping 36, is provided on the leeward side 16 of the dam 10. A concrete strip or riprap 38 is provided along the length of the dam at the water height to eliminate erosion due to wave action.

The dam or levee 10 of the present invention provides for many advantages over prior art dams and levees. One of the highest costs in the construction of dams and levees is the cost of aggregate fill material. In fact, in areas that lack a local supply of aggregate materials, aggregate costs often translate into the cancellation of many worthwhile private and public works projects. With the novel construction of the present invention, the cost of aggregate materials is substantially reduced or even eliminated. Specifically, a project developer's disposal fee for each tire can often exceed the cost of shipping those tires to a construction site. With the novel construction of the present invention, a cost effective source of aggregate fill is obtained with the further advantage of providing an environmentally safe technique for scrap tire disposal. The use of tire bales 12 is advantageous in the construction of dams, boat docks, river bank stabilization structures, hill side building foundations, and costume rock formations or the like because of their unique size, shape, weight, density, and cost efficiency. The installation and engineering properties of the tire bales 12 reduce overall project installation time as well as performing its intended cost effective civil engineering task.

Figure 3:
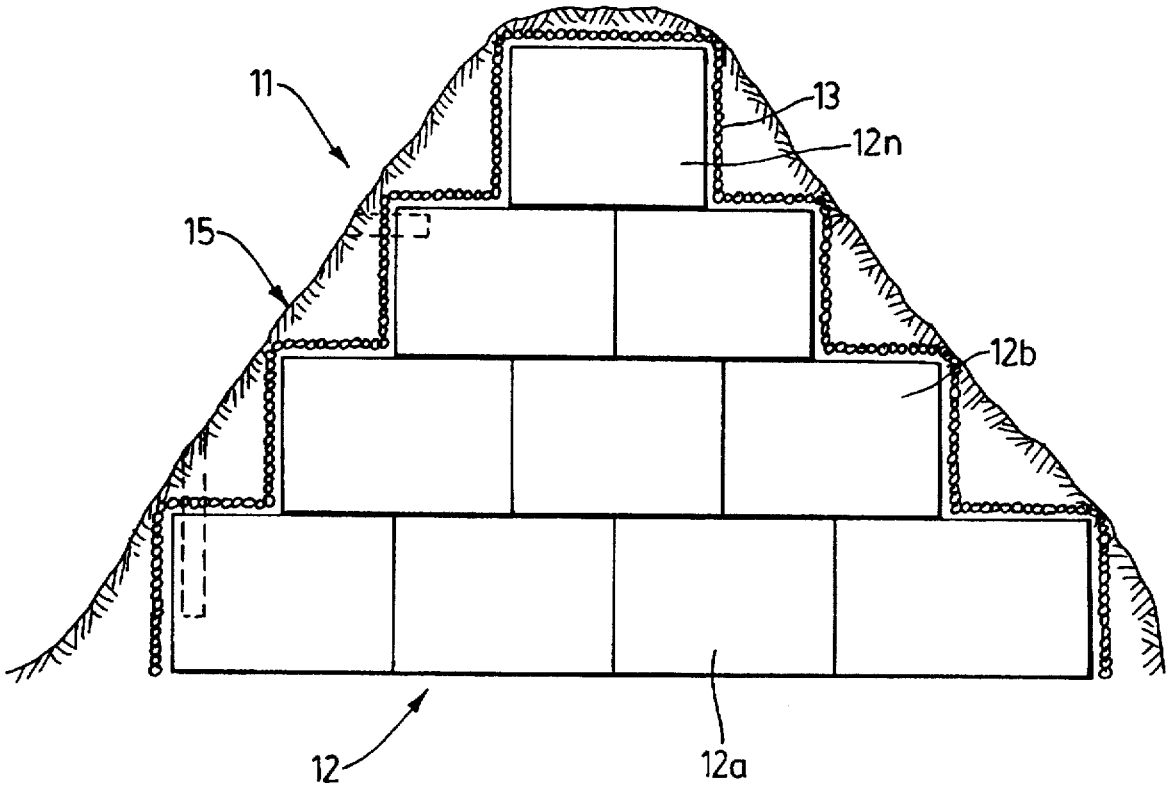
FIG. 3 is an elevation view of a retaining wall in accordance with the present invention configured as a berm.

Similar to the dam construction, the novel system of the present invention may be advantageously used to construct various berm formations. Referring to FIG. 3, there is a novel berm 11 that utilizes tire bales 12 that are stacked upon one another as shown. The particular stacking configuration depends on the particular engineering application of the novel berm 11. For example, the berm 11 comprises a base layer **12*a* having the greatest radial dimension with each subsequent layer 12*b*–12*n*, in turn, having a smaller radial dimension such that the tire bale configuration appears as a pyramid over which a structural material 15 is applied. With the novel tire bales 12, the installation of berm 11 is relatively quick and requires, unlike prior art systems, little earth moving. Once the tire bales 12 are stacked as desired, a geo-membrane 13 is positioned over the stacked tire bales 12 as shown. An appropriate structural material 15 is positioned about the tire bales 12 and preferably over the membrane 13**. For most berm applications, the structural material is soil that will support grass growth and other appropriate vegetation. It is to be understood, however, that other structural materials (e.g. clay or concrete) may be used if a specific application requires.

Figure 4:
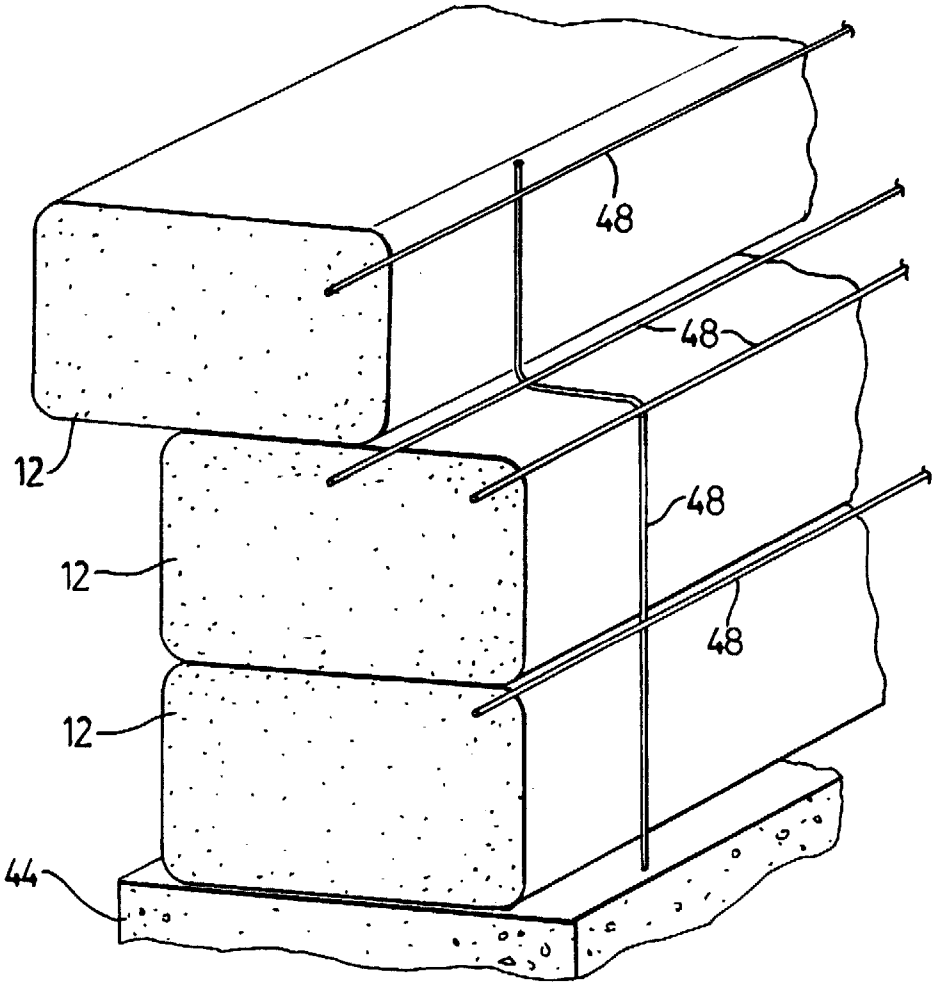
FIG. 4 is a perspective view of tire bale stacks and rebar formation of the retaining wall shown in FIG. 3 of the novel system of the present invention.

The retaining wall system of the present invention has many other applications in the civil engineering art. Referring to FIG. 4, there is shown an alternative embodiment of the retaining wall system of the present invention. Specifically, there is shown a foundation structure 40 defining a floor 42 of a building, deck, or the like. The foundation 40 is particularly suited for construction projects having a site on hill or other mountainous terrain. In this regard, the tire bales 12 provide for increased structural integrity while obtaining the economic advantages noted above (i.e. reduced aggregate cost).

Figure 5:
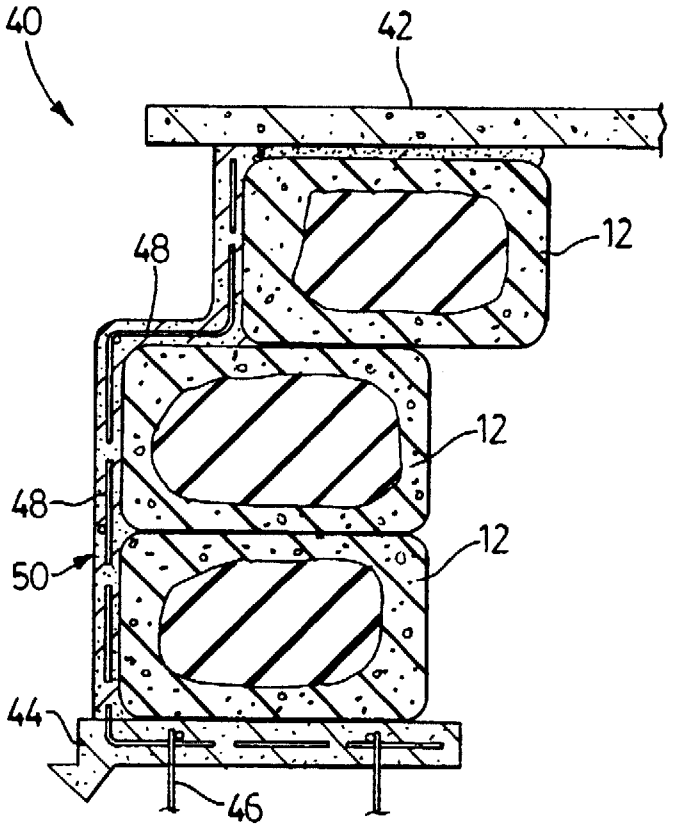
FIG. 5 is a schematic cross-section of a retaining wall system configured as a foundation for a building structure or the like in accordance with the novel system of the present invention.

The retaining wall or foundation 40 includes a concrete footing 44 constructed with rebar dowels 46. Tire bales 12 are stacked on top of the footing 44 in a manner that depends on the desired shape of the final foundation 40. Rebar 48 is bent and formed about the tire bales 12 at least along the outer dimensions of the tire bale layers (note FIG. 5). The plurality of rebar 48 collectively form a frame structure over which a structural material is applied. A granular back fill is preferably introduced in any spaces that exist between adjacent tire bales 12. Once the tire bales 12 are positioned, a structural material is applied onto the surfaces of the tire bales. In the preferred embodiment, a concrete mixture is sprayed onto the tire bale layers over the rebar 48. The concrete mixture preferably comprises cement, gravel, sand, and fiberglass in a ratio of 5/3/3/2 depending on the pressure (psi) requirements. The fiberglass prevents surface cracks in the concrete. The resulting concrete layer 50 is preferably in the order of four inches in order to provide optimal wall integrity. A layer of gravel 52 is provided over the upper most layer of tire bales 12 and is graded in a manner that depends on the application. The flooring 42 is provided on top of the graded surface 52 in a manner that is conventional in the art. The combined tire bale and sprayed concrete construction provides a retaining wall 40 having improved structural integrity. With the novel construction of the present invention, the use of concrete molds to form the foundation is avoided, thereby further reducing the construction cost and the time associated with mold set up. Moreover, unique and complex foundation shapes and configurations can be formed, without the need for costly and complex molds, by merely manipulating the placement of the tire bales.

Figure 6:
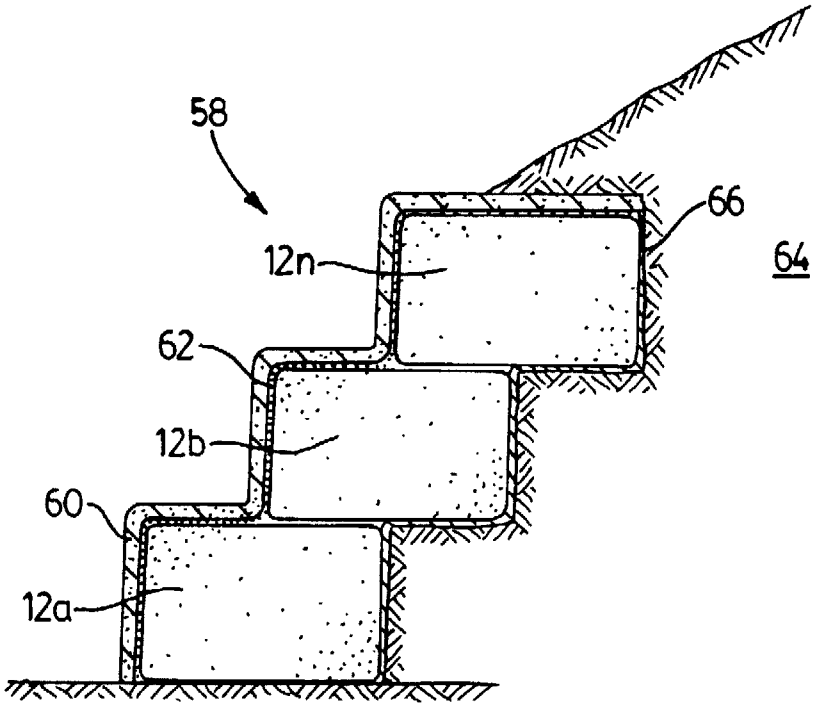
FIG. 6 is a schematic cross-section of a retaining wall system configured as an erosion control wall in accordance with the novel system of the present invention.

Other retaining wall applications are shown and described with reference to FIGS. 6 and 7. In FIG. 6, there is shown an erosion control retaining wall 58 for controlling the erosion and wash away of terrain 64. The wall 58 comprises a plurality of tire bales 12 and a layer of concrete 60. In the embodiment shown, wire mesh 62, as opposed to rebar, is used as the frame structure means for catching and supporting the concrete during the spray process. It is to be noted that either wire mesh or rebar could be used depending on the structural requirements. The tire bales 12 are preferably positioned at an angle of 5 degrees with respect to the vertical horizontal in order to prevent erosion and turn over of the bales. Moreover, bottom layer **12*a* is positioned so that the bottom surface of the tire bales 12 in that row abut the earth (i.e. any suitable support floor) and a side surface of the tire bale abuts the hill terrain 64. Subsequent layers 12*b*–12*n* are arranged such that a portion of the bottom of the tire bales 12 abut a lower and adjacent tire bale layer and another portion of the bottom and a side surface abuts the hillside earth. A geo-textile fabric or water permeable membrane 66** is provided to insure that soil does not wash onto the tire bale layers.

Figure 7:
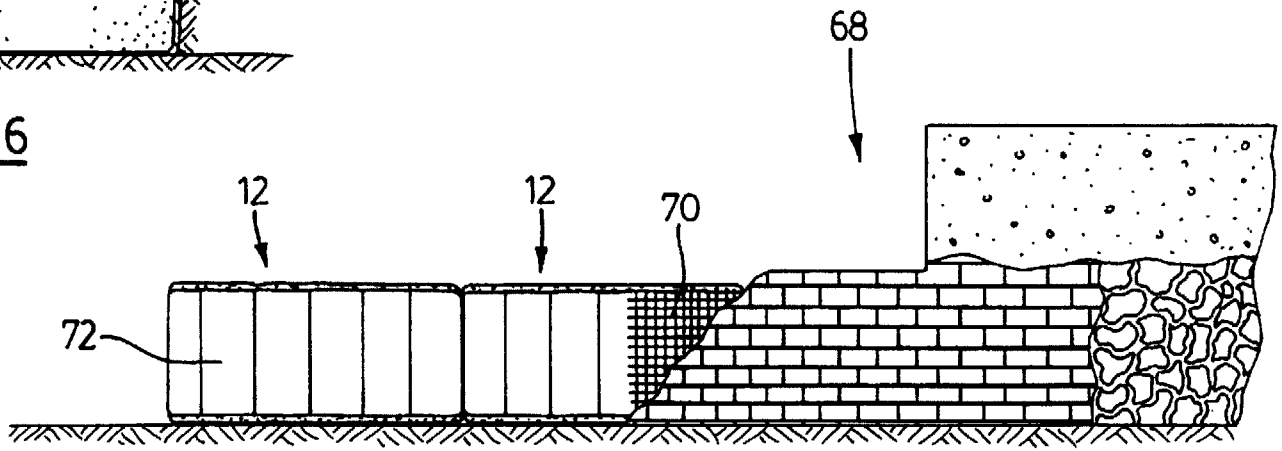
FIG. 7 is a schematic cross-section of a retaining wall system configured as privacy or security fence in accordance with the novel system of the present invention.

Referring now to FIG. 7, a barrier or fence 68 is shown which incorporates the novel system of the present invention. Specifically, tire bales 12 are positioned in a manner so as to define a barrier or fence. A wire mesh 70 is wrapped about the tire bales 12 to form a frame structure as shown and a concrete layer 72 is applied as described above. A decorative stone can be directly secured onto the concrete layer if aesthetics is a consideration.

As disclosed with reference to the various embodiments of the invention, the structural material or coating used over the tire bales 12 can vary depending on the preferred finishes of a given engineering application. Suitable materials include brick, stone, stucco, aggregate, rubber, concrete, wood, clay, soil, and a concrete mortar. The preferred amounts used in a given application depends on the particular materials that are deemed necessary for the structural intent of the installation. The particular specification of the structural material or coating can be determined on a project by project basis by one of skill in the art such as a licensed project engineer.

The method of constructing a retaining wall system in accordance with the present invention is now described. Referring to FIG. 1, a clay core 20 is first constructed in a manner known in the art. A plurality of tire bales 12 are positioned adjacent to the core 20 in a series of rows, each preferably offset from the other. A layer of clay 26 is placed in between each layer 12*a*–12*n* as the layers are positioned. The layers 12*a*–12*n* are stacked until the desired crest height of the dam is obtained (accounting for the additional height of the structural material 30). The relationship of each layer 12*a*–12*n* to an adjacent layer is determined by the required pitch of the water 14 and leeward 16 sides of the dam. Generally, the greater the pitch angle, the lower the degree of off-set between each adjacent layer 12*a*–12*n*. Likewise, the lower a pitch angle is, the greater the degree of off-set between each adjacent layer 12*a*–12*n*. After the tire bale layers 12*a*–12*n* are positioned, a structural material is applied over and about the tire bales 12. In the preferred dam embodiment, the structural material comprises a clay cap 30 that is graded to the desired pitch. Alternatively, a concrete layer could be applied over the tire bales. The method of construction of a berm 11 (note FIG. 3) is substantially as described with reference to the dam structure 10.

Similarly, in the construction of other retaining wall systems (e.g. FIGS. 4–7), the tire bales 12 are first positioned so as to define the configuration of the relevant structure. Rebar 48 or wire mesh 62, 70 is then formed about the tire bales layers as shown in the Figures. A concrete mixture is applied over the rebar 48 or wire mesh 62, 70 in order to form a concrete layer 50, 60, 72.

Figure 8A:
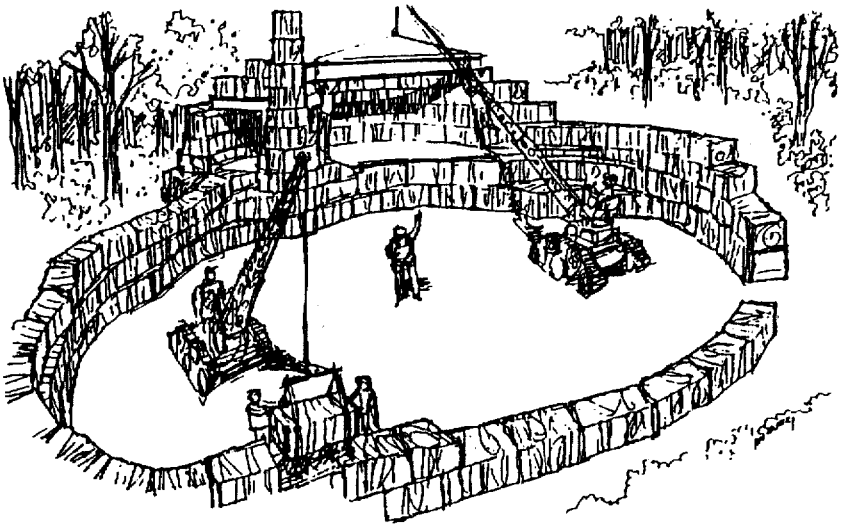
Figure 8B:
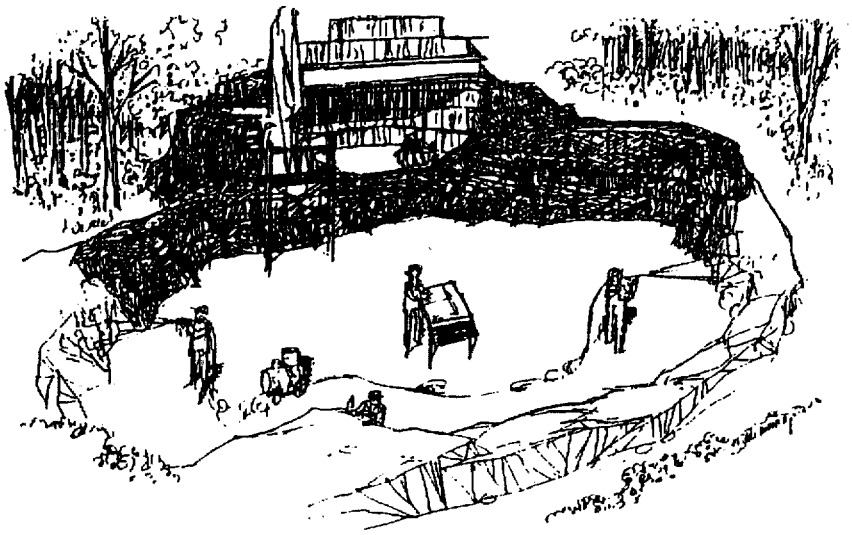
Figure 8C:
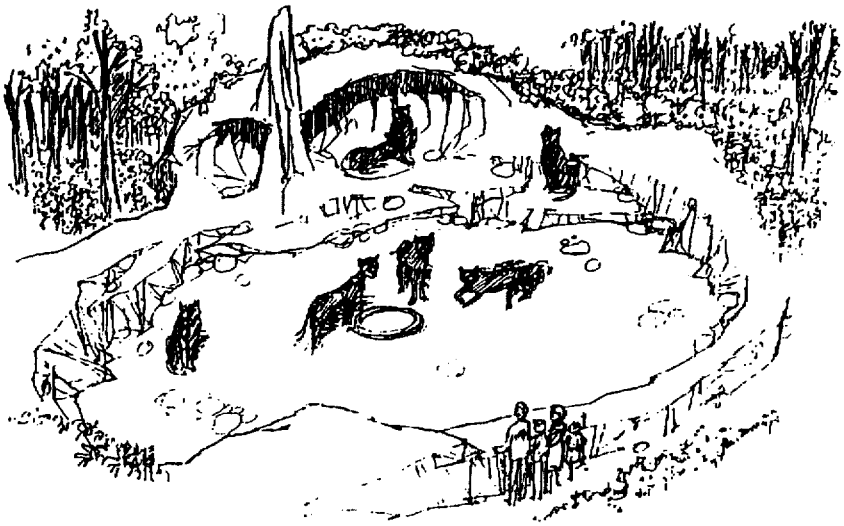

Another embodiment of the invention is shown in FIGS. 8*a*–8*c*. Specifically, shown are schematic diagrams of the progressive construction steps for one embodiment of the present invention configured as an animal containment facility for use in a zoo or the like. With the novel construction method and system, a variety of different animal containment configurations can be constructed.

SUMMARY OF MAJOR ADVANTAGES OF THE INVENTION

After reading and understanding the foregoing detailed description of a retaining wall system and method of construction thereof in accordance with preferred embodiments of the invention, it will be appreciated that several distinct advantages of the subject system and method are obtained.

Without attempting to set forth all of the desirable features of the instant retaining wall system and method of construction thereof, at least some of the major advantages include providing a plurality of scrap tire bales 12 positioned so as to define a retaining wall structure. A structural material 30, 50, 60, 72 is provided about the at least exposed surfaces of the tire components in order to provide a continuous and firm retaining wall structure.

In describing the invention, reference has been made to a preferred embodiment and illustrative advantages of the invention. Those skilled in the art, however, and familiar with the instant disclosure of the subject invention, may recognize additions, deletions, modifications, substitutions and other changes which fall within the purview of the subject invention.

What is claimed:

1. A retaining wall system comprising:

a plurality of distinct scrap tire bales, each said bale including a plurality of scrap tires compressed together to form a block having generally planar surfaces to facilitate stacking of a plurality of said bales in relatively close proximity to one another each said block being bound together with at least one binding strap, said bales being arranged with respect to each other to define a wall structure having an outer surface; and a structural material positioned about said wall structure and over said outer surface to form a continuous outer wall structure.

2. A retaining wall system as defined in claim 1 wherein said structural material comprises clay.

3. A retaining wall system as defined in claim 1 wherein said structural material comprises concrete.

4. A retaining wall system as defined in claim 1 wherein said structural material comprises soil.

5. A retaining wall system as defined in claim 1 wherein said retaining wall system is a dam having a water and leeward side comprising:

a clay core positioned between the water and leeward sides of the dam, said clay core having an upper surface that defines the crest of the dam;

a portion of said plurality of tire bales arranged on the water side of the dam and a portion of said plurality of tire bales arranged on the leeward side of the dam such that said tire bales are arranged in a series of layers, a first layer being positioned on top of earth material and each subsequent tire bale layer being stacked on top of an adjacent tire bale layer;

said structural material positioned over the exposed upper surfaces of each of said series of layers so as to form a continuous dam cap.

6. A retaining wall system as defined in claim 5 wherein said structural material is clay.

7. A retaining wall system as defined in claim 5 wherein a layer of clay is interposed between each adjacent tire bale layer.

8. A retaining wall system as defined in claim 5 wherein each of said tire bale layers are offset with respect to an adjacent tire bale layer such that said first tire bale layer extends a linear distance from said core and each subsequent layer, in turn, extends a linear distance less than that of said first and adjacent tire bale layer.

9. A retaining wall system as defined in claim 1 further comprising:

a plurality of rebar configured to conform to the shape of the outer surface of said wall structure;

said structural material being a concrete mixture applied over said rebar and said outer surface so as to form a concrete layer.

10. A retaining wall system as defined in claim 9 wherein said concrete layer is at least four (4) inches in depth.

11. A retaining wall system as defined in claim 1 wherein said retaining wall system is a berm further defined such that:

said plurality of tire bales are arranged in a series of layers, a first layer being positioned on top of earth material and each subsequent tire bale layer being stacked on top of an adjacent tire bale layer such that the first layer defines the base of said berm structure extending a radial dimension from a central point of said first layer and each subsequent layer, in turn, extends a radial distance less than that of said first and adjacent tire bale layer; and said structural material positioned over the exposed upper surfaces of each of said series of layers so as to form a continuous berm cap.

12. A retaining wall system as defined in claim 11 wherein said structural material is soil.

13. A retaining wall system as defined in claim 1 wherein said retaining wall system is an erosion control barrier to retain the flow of earth on a hill terrain further defined by:

each of said tire bales having a bottom surface and a side surface; said plurality of tire bales are arranged in a series of layers, a first layer comprising a plurality of tire bales positioned with their respective bottom surfaces lying on top of earth material and with a respective side surface abutting earth that defines the hill terrain, and each subsequent tire bale layer being stacked on top of an adjacent tire bale layer such that at least a row of tire bales in said layer have a portion of said bottom surface abutting an adjacent tire bale layer and another portion of said bottom surface and said respective side surfaces abutting the earth that defines said hill terrain; and said structural material positioned over the exposed surfaces of each of said series of layers so as to form a continuous wall structure.

14. A retaining wall system as defined in claim 13 wherein said structural material is concrete.

15. A retaining wall system as defined in claim 1 wherein said block is a parallelepiped.

16. A retaining wall system as claimed in claim 1, wherein each of said plurality of distinct scrap tire bales comprises whole automobile scrap tires.

17. A retaining wall system comprising:

a plurality of distinct scrap tire bales, each said bale including a plurality of scrap tire shreds mixed with cement and molded into a stackable block, said bales being arranged with respect to each other to define a wall structure having an outer surface; and a structural material positioned about said wall structure and over said outer surface to form a continuous outer wall structure.

18. A retaining wall system as defined in claim 17 wherein said unitary block is further encapsulated in a uniform layer of concrete.

19. A method of constructing a retaining wall comprising the steps of:

positioning a plurality of distinct scrap tire bales with respect to each other to define a wall structure having an outer surface, each said bale including a plurality of scrap tires compressed together to form a block having generally planar surfaces to facilitate stacking of a plurality of said bales in relatively close proximity to one another, each said block being bound together with at least one binding strap; and applying a structural material about said wall structure and over said outer surface to form a continuous outer wall structure.

20. A method of constructing a retaining wall in accordance with claim 19 further defined by:

positioning a concrete support frame about said wall structure and over said outer surface of said wall structure; and wherein said applying step comprises spraying a concrete mixture over said concrete support frame.

* * * * *